US005236035A

United States Patent [19]

Brisco et al.

[11] Patent Number: 5,236,035

[45] Date of Patent: Aug. 17, 1993

[54] SWIVEL CEMENTING HEAD WITH MANIFOLD ASSEMBLY

[75] Inventors: David P. Brisco; Morris G. Baldridge, both of Duncan, Okla.; David D. McGuire, Tananger, Norway

[73] Assignee: Halliburton Company, Duncan, Okla.

[21] Appl. No.: 834,926

[22] Filed: Feb. 13, 1992

[51] Int. Cl.[5] ..... E21B 33/05

[52] U.S. Cl. ..... 166/70; 166/285; 166/291

[58] Field of Search ..... 166/70, 285, 291

[56] References Cited

U.S. PATENT DOCUMENTS

| | | | |
|---|---|---|---|
| 2,029,598 | 2/1936 | Timbs et al. | 285/61 |
| 2,196,652 | 4/1940 | Baker | 166/156 |
| 2,599,039 | 6/1952 | Baker | 166/78 |
| 2,630,179 | 3/1953 | Brown | 166/291 |
| 2,647,582 | 8/1953 | Brown et al. | 166/70 |
| 3,076,509 | 2/1963 | Burns et al. | 166/70 |
| 3,322,197 | 5/1967 | Baker et al. | 166/75 |
| 3,616,850 | 11/1971 | Scott | 166/155 |
| 3,777,819 | 12/1973 | Delano | 166/285 |
| 3,779,270 | 12/1973 | Davis | 137/268 |
| 3,971,436 | 7/1976 | Lee | 166/70 |
| 4,234,216 | 11/1980 | Swanson et al. | 285/93 |
| 4,246,967 | 1/1981 | Harris | 166/291 |
| 4,290,482 | 9/1981 | Brisco | 166/70 |
| 4,302,033 | 11/1981 | Evans et al. | 285/14 |
| 4,427,065 | 1/1984 | Watson | 166/250 |
| 4,624,312 | 11/1986 | McMullin | 166/155 |
| 4,722,389 | 2/1988 | Arnold | 166/70 |
| 4,995,457 | 2/1991 | Baldridge | 166/70 |

OTHER PUBLICATIONS

Halliburton Services Sales & Service Catalog No. 43 (1985), pp. 2423–2426.

Halliburton Company Advertising Brochure, SSR (Subsurface Release Cementing Plug System), 3 pages, Jul. 15, 1981.

*Composite Catalog of Oil Field Equipment & Services,* 35th Rev., 1982–83, vol. 6, Bowen Tools, Inc., 2 pages.

*Composite Catalog of Oil Field Equipment & Services,* 35th Rev., 1982–83, vol. 1, A–Z International Tool Company, p. 18.

Roto–Tek advertising brochure, four pages, dated Nov. 17, 1989.

Lindsey Completion Systems, Advertisement, Cementing Equipment, 1 page, Nov. 17, 1987.

*Primary Examiner*—Stephen J. Novosad

*Attorney, Agent, or Firm*—James R. Duzan; Neal R. Kennedy

[57] ABSTRACT

A swivel cementing head with manifold assembly. The assembly comprises a body connectable to a tool string, and a cementing manifold connectable to the cement source. The manifold is rotatably mounted on the body to provide continuous fluid communication between the manifold and body even when the body is rotating with respect to the manifold. The rotatable connection is provided by a mandrel extending from the body and the sleeve connected to the manifold. The mandrel defines a mandrel central opening therethrough and a transverse mandrel hole in communication with the mandrel opening, and the sleeve defines a transverse sleeve hole therethrough. The mandrel has a mandrel groove and an outwardly facing surface thereof adjacent to the mandrel hole, and the sleeve has a sleeve groove in an inwardly facing surface thereof adjacent to the sleeve hole. The sleeve and mandrel grooves are substantially aligned and define an annular channel therebetween which assures fluid communication between the mandrel hole and sleeve hole. Two such swivel connections are preferably used. A plug release and a ball release allow plugs and/or balls to be released for pumping down the tool string. A plug release indicator is also provided in the preferred embodiment.

17 Claims, 2 Drawing Sheets

SWIVEL CEMENTING HEAD WITH MANIFOLD ASSEMBLY

BACKGROUND OF THE INVENTION

1. Field Of The Invention

The present invention relates to cementing head apparatus, and more particularly, to a cementing head having a plug container body rotatable with respect to a cementing manifold while maintaining fluid communication therebetween. This allows simultaneous rotation from above and reciprocation of the cementing head while pumping to improve cement flow through the apparatus and drill string or casing attached thereto.

2. Description Of The Prior Art

One type of cementing apparatus which is commonly used in the completion of offshore wells is that known as a subsurface release cementing system. In a subsurface release cementing system, cement plugs are hung off in the upper end of the casing near the ocean floor. Devices such as balls and darts are released from a plug container or cementing head located at the floating drilling rig. The balls or darts fall downwardly through the drill pipe to engage the cementing plugs hung off in the casing head and to cause those cementing plugs to be released so that they will then flow downwardly through the casing with the cement.

One such system is shown in U.S. Pat. No. 4,624,312 to McMullin, assigned to the assignee of the present invention. These types of cementing plug methods and equipment are also described in Halliburton Sales & Service Catalog No. 43 (1985), pages 2423–2426. In this apparatus there is a cementing manifold attached to the plug container above and below the top releasing plug and plug release.

It is known to construct the cementing head in what is known as a "lift-through" design, wherein the entire weight of the drill pipe string hung below the drilling platform is supported through or lifted through the structure of the cementing head. This allows the plug container and drill pipe string to be reciprocated during cementing operations to help remove mud from the well annulus and provide an even distribution of cement in the annulus. This reciprocation is accomplished by attaching the rig elevators to the apparatus so that the cementing head and drill string may be reciprocated by the elevators.

While reciprocation of the apparatus during cementing has the advantages mentioned, rotation of the casing also helps provide better cement flow. A problem with the prior art cementing heads described above is that the cementing manifold is rigidly connected to the plug container body so that rotation of the body is prevented because of the cementing lines connected to the cementing manifold. Thus, the only way to rotate the casing was to disconnect the cementing lines prior to rotation. In other words, rotation could not occur while cement was actually being pumped.

Lift-through cementing heads have been developed with swivel connections between the plug container body and the drill pipe string therebelow. One such apparatus is disclosed in U.S. patent application Ser. No. 07/444,657, now U.S. Pat. No. 4,995,457 assigned to the assignee of the present invention. By engaging the drill pipe string below the swivel by the slips on the rig floor, rotation is possible without disconnecting the cementing lines from the cementing manifold. Thus, cement can be pumped through the apparatus and down the drill pipe string while the drill pipe string is rotated. However, the apparatus may not be reciprocated and rotated at the same time since the rotation is provided by the slips on the rig floor below the cementing head.

Accordingly, there is a need for a cementing head which may be both reciprocated and rotated simultaneously with the pumping of cement through the apparatus and down the drill pipe string. The present invention meets this need by providing a cementing head with a plug container body which may be rotated with respect to the cementing manifold while maintaining fluid communication therebetween so that cement may be pumped during rotation. With the present invention, rotation may be provided by top drive units above the apparatus which may be rotated substantially simultaneously with reciprocation by the elevators. Thus, the cementing head of the present apparatus may be reciprocated and rotated during a cement pumping operation.

SUMMARY OF THE INVENTION

The cementing head apparatus of the present invention is adapted for use in downhole cementing, particularly the type of cementing used in the completion of offshore wells. The cementing head apparatus comprises a body connectable to a tool string, a cementing manifold connectable to a cement source, and mounting means for rotatably mounting the manifold on the body and providing continuous fluid communication between the manifold and body. In the preferred embodiment, the mounting means is characterized by a swivel connection comprising a mandrel extending from the body and a sleeve connected to the manifold and rotatably disposed around the mandrel. The mandrel defines a mandrel central opening therethrough and a transverse mandrel hole in communication with the mandrel central opening, and the sleeve defines a transverse sleeve hole therethrough in fluid communication with the mandrel hole.

The mandrel may have a mandrel groove in an outwardly facing surface thereof adjacent to the mandrel hole, and the sleeve may have a sleeve groove in an inwardly facing surface thereof adjacent to the sleeve hole. When the sleeve and mandrel grooves are substantially aligned, they define a generally annular channel therebetween.

The cementing head apparatus further comprises bearing means for rotatably mounting the sleeve on the mandrel. This bearing means is preferably characterized by a tapered roller thrust bearing.

A sealing means provides sealing between the mandrel and sleeve, and this sealing means may include a means for sealing on opposite sides of the bearing means.

The cementing head apparatus may further comprise releasing means for releasing a plug positionable in the body so that the plug may be pumped downwardly through the tool string for a purpose such as releasing a subsurface release plug. An indicating means is provided for indicating that the plug has passed thereby. The mounting means may comprise a swivel connection on opposite sides of the releasing means.

In the swivel connection, the mandrel preferably comprises a flange portion, and the sleeve comprises a shoulder thereon facing the flange portion. The bearing means is disposed between the flange portion and shoulder. Preferably, the sleeve also comprises a second shoulder thereon, and a second bearing is positioned adjacent to the second shoulder. A nut threadingly engaged with the mandrel is adjacent to the second bearing and is used to clamp the bearing in an operating position.

An important object of the present invention is to provide a cementing head which may be reciprocated and rotated while pumping cement therethrough.

Another object of the invention is to provide a cementing head with a plug container body which is rotatable with respect to a cementing manifold while maintaining fluid communication therebetween.

An additional object of the invention is to provide a cementing manifold attached to a plug container body by swivel connections.

Additional objects and advantages of the invention will become apparent as the following detailed description of the preferred embodiment is read in conjunction with the drawings which illustrate such embodiment.

DESCRIPTION OF THE PREFERRED EMBODIMENT

Figures 1A, 1C:
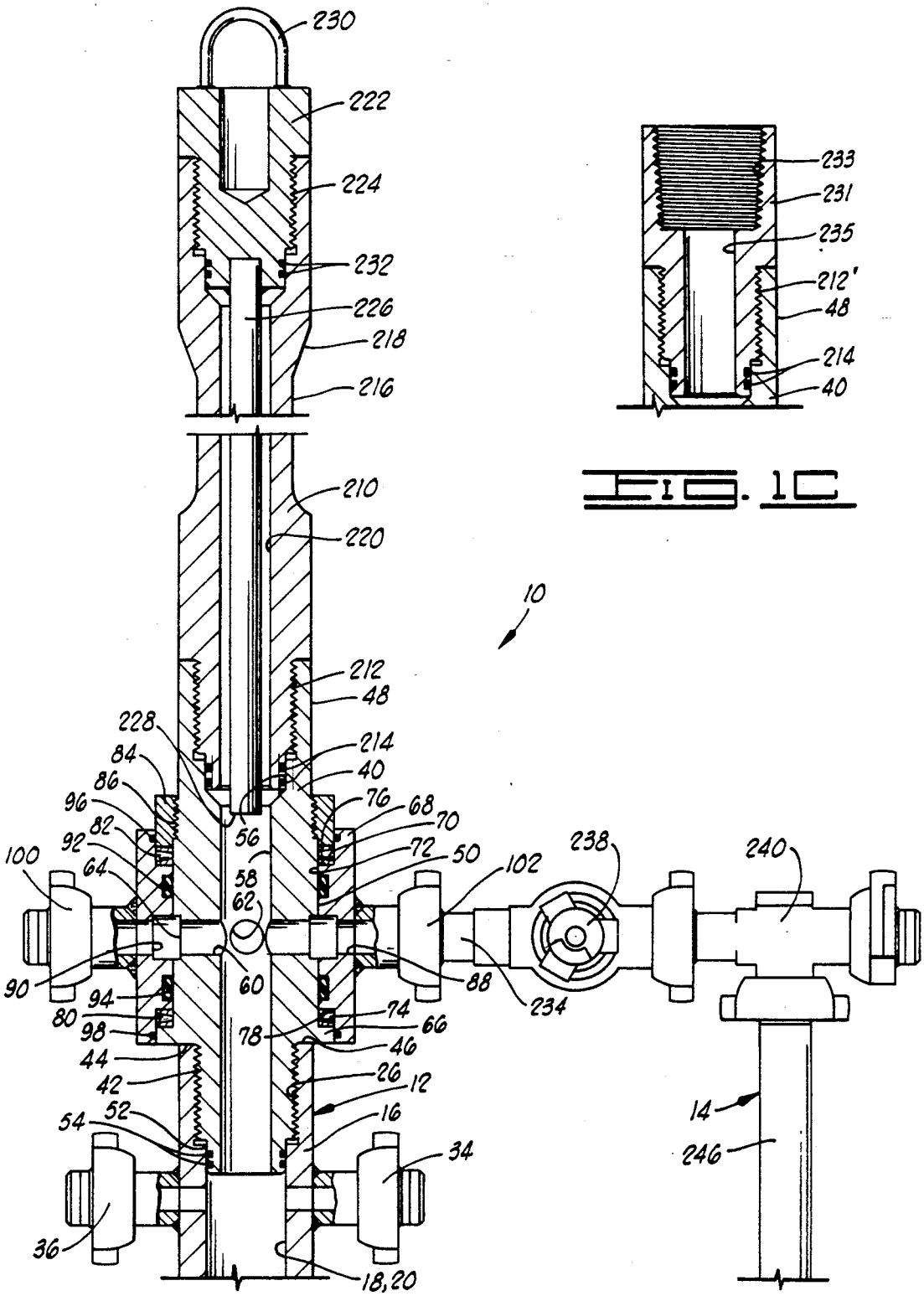
FIGS. 1A and 1B show the swivel cementing head with manifold assembly of the present invention with many of the components in cross section and the manifold in elevation.
FIG. 1C shows an upper adapter attached to the upper swivel mandrel.
Figure 1B:
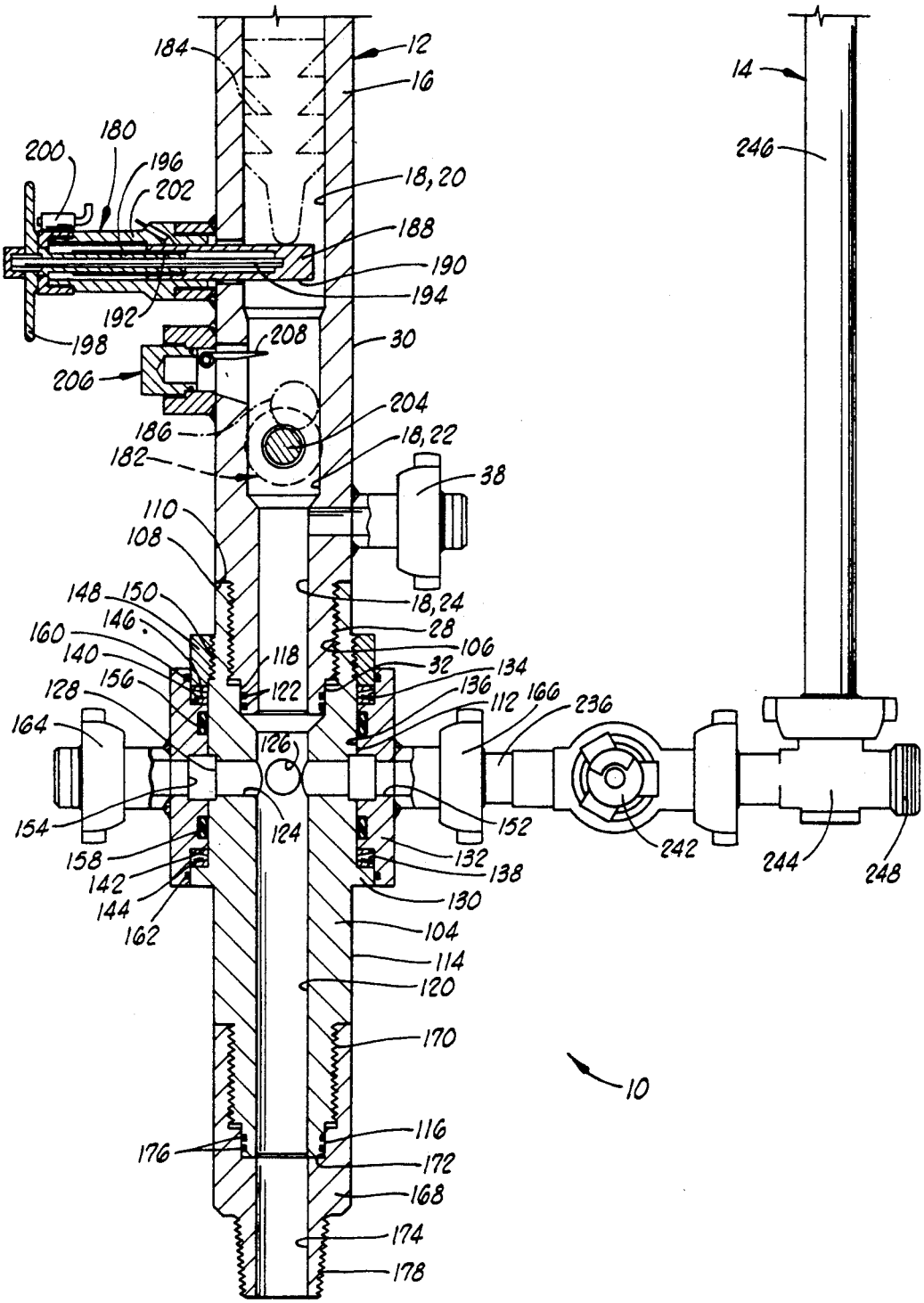

Referring now to the drawings, the swivel cementing head with manifold assembly of the present invention is shown and generally designated by the numeral 10. Generally, cementing head 10 comprises a body assembly 12 with a manifold assembly 14 attached thereto while allowing relative rotation therebetween as will be further described herein.

A major component of body assembly 12 is a plug container body 16 which defines a central opening 18 therethrough. Central opening 18 is formed by a first bore 20 in body 16, a slightly smaller second bore 22, and an even smaller third bore 24. Above first bore 20 at the upper end of body 16 is an internally threaded surface 26, and at the lower end of body 16 is an externally threaded surface 28. Container body 16 has a first outside diameter 30 above externally threaded surface 28 and a smaller second outside diameter 32 below externally threaded surface 28.

As illustrated, container body 16 is of a kind known in the art, such as that used in the apparatus of U.S. patent application Ser. No. 07/444,657, now U.S. Pat. No. 4,995,457, and is therefore illustrated with a plurality of hammer unions 34, 36 and 38 which are attached to first outside diameter 30 of container body 16 by any means known in the art, such as welding. As will be further explained herein, these particular hammer unions 34, 36 and 38 are not used in the present invention, and accordingly, hammer unions 34, 36 and 38 are simply plugged off in any known manner. Thus, it will be seen by those skilled in the art that rather than using the illustrated prior art container body 16, a new, slighly different container body 16 could be utilized without hammer unions 34, 36 and 38 at all.

An upper swivel mandrel 40 is attached to the upper end of container body 16 by the engagement of externally threaded surface 42 on upper swivel mandrel 40 with internally threaded surface 26 in container body 16. Thus, it may be said that a threaded connection 42, 26 is formed. When this threaded connection 42, 26 is completed, a downwardly facing shoulder 44 on upper swivel mandrel 40 preferably engages upper end 46 of container body 16.

Upper swivel mandrel 40 has a first outside diameter 48, a second outside diameter 50, and a third outside diameter 52. Third outside diameter 52 on upper swivel mandrel 40 extends into first bore 20 in container body 16. A sealing means, such as O-rings 54, provides sealing engagement between upper swivel mandrel 40 and container body 16.

Upper swivel mandrel 40 defines a first bore 56 and a second bore 58 therein which define a longitudinally extending central opening therethrough. It will be seen that second bore 58 in upper swivel mandrel 40 is in communication with central opening 18 in container body 16.

A transverse hole 60 extends through upper swivel mandrel 40 and intersects, and thus is in communication with, second bore 58. Upper swivel mandrel 40 may also include another transverse hole 62 which is aligned longitudinally with transverse hole 60. In the embodiment shown, holes 60 and 62 are perpendicular to one another, but this is not required. An annular undercut or groove 64 is formed around the outer ends of transverse holes 60 and 62. The width of undercut 64 is preferably larger than the diameter of holes 60 and 62. Thus, holes 60 and 62 do not extend to second outside diameter 50 of upper swivel mandrel 40.

An annular flange 66 extends outwardly on upper swivel mandrel 40 below second outside diameter 50.

Rotatably disposed around upper swivel mandrel 40 is an upper swivel sleeve 68. Upper swivel sleeve 68 defines a first bore 70 therein, a second bore 72 which is in close relationship with second outside diameter 50 on upper swivel mandrel 40, and a third bore 74 which is substantially the same size as first bore 70. An upwardly facing annular shoulder 76 extends between first bore 70 and second bore 72, and a similar downwardly facing annular shoulder 78 extends between second bore 72 and third bore 74.

A thrust bearing 80 is disposed in the annular gap defined between third bore 74 in upper swivel sleeve 68 and second outside diameter 50 on upper swivel mandrel 40. It will be seen that thrust bearing 80 is thus longitudinally positioned between flange 66 on upper swivel mandrel 40 and shoulder 78 on upper swivel sleeve 68.

A similar or identical thrust bearing 82 is disposed in the annular gap defined between first bore 70 in upper swivel sleeve 68 and second outside diameter 50 on upper swivel mandrel 40. A nut 84 is attached to upper swivel mandrel 40 at threaded connection 86 and clamps thrust bearing 82 against shoulder 76 on upper swivel sleeve 68. Those skilled in the art will also see that the other thrust bearing 80 is also clamped in place, and upper swivel sleeve 68 is longitudinally locked in position with respect to upper swivel mandrel 40. However, upper swivel mandrel 40 is free to rotate within upper swivel sleeve 68 on thrust bearings 80 and 82. Thrust bearings 80 and 82 are preferably tapered roller thrust bearings, but many known bearing configurations could be used.

Upper swivel sleeve 68 defines a transverse hole 88 therethrough which is longitudinally aligned with transverse holes 60 and 62 in upper swivel mandrel 40. An annular undercut or groove 90 is defined in upper swivel sleeve 68 and is aligned and in communication with undercut 64 in upper swivel mandrel 40. Undercut 90 is preferably wider than the diameter of transverse hole 88 so that transverse hole 88 does not actually extend to second bore 72 in upper swivel sleeve 68. It will be seen that undercuts 64 and 90 define an annular channel between upper swivel sleeve 68 and upper swivel mandrel 40, and it will be further seen that transverse hole 88 is therefore always in fluid comunication with transverse holes 60 and 62. Thus, hole 88 is also in fluid com-munication with second bore 58 in upper swivel mandrel 40, regardless of the rotated position of upper swivel mandrel 40 with respect to upper swivel sleeve 68.

A sealing means, such as a pair of packing rings 92 and 94, provides sealing engagement between upper swivel sleeve 68 and upper swivel mandrel 40 on opposite sides of the annular channel formed by undercuts 64 and 90. Another sealing means, such as O-ring 96, provides sealing engagement between upper swivel mandrel 68 and nut 84. A further sealing means, such as O-ring 98, provides sealing engagement between upper swivel sleeve 68 and flange 66 on upper swivel mandrel 40 below thrust bearing 80.

A pair of hammer unions 100 and 102 are attached to the outside of upper swivel sleeve 68 by any means known in the art, such as by welding. Hammer unions 100 and 102 are aligned with opposite ends of transverse hole 88. Hammer unions 100 and 102 are of a kind known in the art and are similar or identical to hammer unions 34, 36 and 38, previously described.

Referring now to FIG. IB, a lower swivel mandrel 104 is attached to the lower end of container body 16 by the engagement of internally threaded surface 106 in lower swivel mandrel 104 with externally threaded surface 28 on container body 16. Thus, it may be said that a threaded connection 106, 28 is formed. When this threaded connection 106, 28 is completed, a downwardly facing shoulder 108 on container body 16 preferably engages upper end 110 of lower swivel mandrel 104.

Lower swivel mandrel 104 has a first outside diameter 112, a second outside diameter 114, and a third outside diameter 116.

Lower swivel mandrel 104 has a first bore 118 disposed longitudinally therein and a second bore 120 longitudinally therethrough which define a longitudinally extending central opening. It will be seen that second bore 120 in lower swivel mandrel 104 is in communication with central opening 18 in container body 16.

Second outside diameter 32 of container body 16 extends into first bore 118 in lower swivel mandrel 104. A sealing means, such as a pair of O-rings 122, provides sealing engagement between container body 16 and lower swivel mandrel 104.

A transverse hole 124 extends through lower swivel mandrel 104 and intersects, and is thus in communication with, second bore 120 Lower swivel mandrel 104 may also include another transverse hole 126 which is aligned longitudinally with transverse hole 124. In the embodiment shown, holes 124 and 126 are perpendicular to one another, but this is not required. An annular undercut or groove 128 is formed around the outer ends of transverse holes 124 and 126. The width of undercut 128 is preferably larger than the diameter of holes 124 and 126. Thus, holes 124 and 126 do not extend to second outside diameter 112 of lower swivel mandrel 104.

An annular flange 130 extends outwardly on lower swivel mandrel 104 below second outside diameter 112.

Rotatably disposed around lower swivel mandrel 104 is a lower swivel sleeve 132. Lower swivel sleeve 132 defines a first bore 134 therein, a second bore 136 which is in close relationship with second outside diameter 112 on lower swivel mandrel 104, and a third bore 138 which is substantially the same size as first bore 134. An upwardly facing annular shoulder 140 extends between first bore 134 and 136, and a similar downwardly facing annular shoulder 142 extends between second bore 136 and third bore 138.

A thrust bearing 144 is disposed in the annular gap defined between third bore 138 in lower swivel sleeve 132 and first outside diameter 112 on lower swivel mandrel 104. It will be seen that thrust bearing 144 is thus longitudinally positioned between flange 130 on lower swivel mandrel 104 and shoulder 142 on lower swivel sleeve 132.

A similar or identical thrust bearing 146 is disposed in the annular gap defined between first bore 134 in lower swivel sleeve 132 and first outside diameter 112 on lower swi-vel mandrel 104. A nut 148 is attached to lower swivel mandrel 104 at threaded connection 150 and clamps thrust bearing 146 against shoulder 140 on lower swivel sleeve 132. Those skilled in the art will also see that the other thrust bearing 144 is clamped in place, and lower swivel sleeve 132 is longitudinally locked into position with respect to lower swivel mandrel 104. However, lower swivel mandrel 104 is free to rotate within lower swivel sleeve 132 on thrust bearings 144 and 146. Thrust bearings 144 and 146 are preferably identical to thrust bearings 80 and 82 previously described.

Lower swivel sleeve 132 defines a transverse hole 152 therethrough which is longitudinally aligned with transverse holes 124 and 126 in lower swivel mandrel 104. An annular undercut or groove 154 is defined in lower swivel sleeve 132 and is aligned and in communication with undercut 128 in lower swi-vel mandrel 104. Undercut 154 is preferably wider than the diameter of transverse hole 152 so that transverse hole 152 does not actually extend to second bore 120 in lower swivel sleeve 132. It will be seen that undercuts 128 and 154 define an annular channel between lower swivel sleeve 132 and lower swivel mandrel 104, and it will be further seen that transverse hole 152 is therefore always in fluid communication with transverse holes 124 and 126. Thus, hole 152 is also in fluid communication with second bore 120 in lower swivel mandrel 104, regardless of the rotated position of lower swivel mandrel 104 with respect to lower swivel sleeve 132.

A sealing means, such as a pair of packing rings 156 and 158, provides sealing engagement between lower swivel sleeve 132 and lower swivel mandrel 104 on opposite sides of the annular channel formed by undercuts 128 and 154. Another sealing means, such as O-ring 160, provides sealing engagement between lower swivel mandrel 104 and nut 148. A further sealing means, such as O-ring 162, provides sealing engagement be-tween lower swivel sleeve 132 and flange 130 on lower swivel mandrel 104 below thrust bearing 144.

A pair of hammer unions 164 and 166 are attached to the outside of lower swivel sleeve 132 by any means known in the art, such as by welding. Hammer unions 164 and 166 are aligned with opposite ends of transverse hole 152. Hammer unions 164 and 166 are of a kind known in the art and are substantially identical to hammer unions 34, 36, 38, 100 and 102, previously described.

The lower end of lower swivel mandrel 104 is attached to a lower adapter 168 at threaded connection 170. Lower adapter 168 is of a kind known in the art and has a first bore 178 therein and a second bore 174 therethrough. Third outside diameter 116 of lower swivel mandrel 104 extends into first bore 172 in lower adapter 168. A sealing means, such as a pair of O-rings 176, provides sealing engagement between lower swivel mandrel 104 and lower adapter 168. It will be seen that second bore 174 in lower adapter 168 is in communication with second bore 120 in lower swivel mandrel 104

Lower adapter 168 has an externally threaded surface 178, which is preferably a standard tapered threaded pin connection, thereon for connection to a string of drill pipe (not shown) suspended therefrom in a manner known in the art. Lower adapter 168 may be said to be a portion of body assembly 12.

Still referring to FIG. IB, cementing head apparatus 10 includes an upper releasing assembly or mechanism 180 and a lower releasing assembly or mechanism 182 associated with an elongated releasing dart 184 and a spherical releasing ball 186, respectively. Upper and lower releasing mechanisms 180 and 182 are preferably angularly spaced about the longitudinal axis of cementing head apparatus 10 at an angle of about 90°. Upper and lower releasing mechanisms 180 and 182 are of a kind known in the art, and the details of construction of the releasing mechanisms are substantially identical. Those details will be described with regard to upper releasing mechanism 180.

Upper releasing mechanism 180 includes a cylindrical release plunger 188 operably associated with container body 16 and movable between a first position shown in FIG. IB wherein plunger 188 extends into first bore 20 of container body 16 and a second position (not shown) wherein plunger 188 is completely withdrawn from first bore 20. Plunger 188 has an outside diameter 190. Plunger 188 is hollow and has an internal thread 192 therein. A centering shaft 194 is positioned in plunger 188. A hollow shaft 196 is positioned around centering shaft 194 and engaged with internal thread 192 in piston 188. A handle or hand wheel 198 is attached to hollow shaft 196 and may be rotated to cause plunger 188 to move radially along hollow shaft 196. A locking mean 200 releasably latches handle 198 in place. As handle 198 is rotated, plunger 188 withdraws into a hollow body 202 of releasing mechanism 180 due to the engagement of hollow shaft 196 with internal thread 192.

As indicated, lower releasing mechanism 182 is substantially identical and includes a plunger 204 which extends into second bore 22 in container body 16 in much the same way as plunger 188 extends into first bore 20.

Ball 186 is dimensioned so that when plunger 204 is extended into second bore 22 in container body 16, ball 186 will be located above and will engage plunger 204 of lower releasing mechanism 182 Similarly, dart 184 is sized and positioned such that it initially engages plunger 188 of upper releasing mechanism 180. When plunger 204 of lower releasing mechanism 182 is retracted, ball 186 is permitted to drop through cementing head apparatus 10. When plunger 188 of upper releasing mechanism 180 is retracted, dart 184 is permitted to drop through cementing head apparatus 10. Dart 184 and ball 186 are of a kind known in the art, and the releasing of the dart and ball is also of a kind known in the art.

An indicator mechanism 206 is mounted on container body 16 between upper and lower releasing mechanisms 180 and 182. Indicator mechanism 206 has a trip lever 208 extending into second bore 22 of container body 16. Trip lever 58 will trip when dart 184 passes downwardly through container body 16, thereby providing an indication that the dart has been released.

Referring again to FIG. IA, a lifting sub 210 may be attached to upper swivel mandrel 40 at threaded connection 212. A sealing means, such as a pair of O-rings 214, provides sealing engagement between lifting sub 210 and first bore 56 in upper swivel mandrel 40.

Lifting sub 210 has a reduced diameter external surface 216 and a downwardly facing tapered shoulder 218 about which a conventional pair of elevator bales (not shown) of a drilling rig may be placed in order to lift lifting sub 210 and the various apparatus components suspended therefrom as further described herein. Lifting sub 210 itself is of a kind known in the art.

Lifting sub 210 has a loading bore 220 defined therethrough which is in communication with second bore 58 in upper swivel mandrel 40. Loading bore 220 is approximately the same size as second bore 58 in upper swivel mandrel 40, and both of these bores have a diameter greater than the diameter of releasing ball 186 so that the releasing ball can pass downwardly therethrough. Releasing dart 184 has large diameter wiper cups thereon which are very flexible and can be compressed sufficiently so that dart 184 can also be pushed downwardly through loading bore 220 in lifting sub 210 and second bore 58 in upper swivel body 40.

An upper cap 222 is detachably connected to the upper end of lifting sub 210 at threaded connection 224, thus closing loading bore 220. Upper cap 222 has a rod 226 extending downwardly therefrom through loading bore 222. Upper cap 222 and rod 226 are both of a kind known in the art. Rod 226 serves two purposes. First, rod 226 may be utilized to push releasing dart 184 through loading bore 220. Second, a lower end 228 of rod 226 prevents dart 184 from floating upwardly far enough to cause any operational difficulties during the cementing job. The loading of releasing dart 184 through lifting sub 220 in the manner described is not necessary because releasing dart 184 may be positioned in container body 16 prior to installation of upper swivel mandrel 40.

Upper cap 222 has a handle loop 230 attached thereto for handling of upper cap 222 and rod 226. A sealing means, such as a pair of O-rings 232, provides sealing engagement between cap 222 and lifting sub 210.

As will be further described herein, lifting sub 210 may be removed from upper swivel mandrel 40 prior to operation so that a top drive unit (not shown) of the drilling rig may be used. In this case, an upper adapter 231 is attached to upper swivel mandrel 40 at threaded connection 212'. O-rings 214 provide a sealing means for sealing between upper adapter 231 and upper swivel mandrel 40. Upper adapter 231 preferably has an internal tapered thread 233 which is adapted for engagement by the top drive unit. The top drive unit may then be used to rotate the apparatus during the cementing job as will be hereinafter described.

Manifold assembly 14 is connected to upper swivel sleeve 68 through hammer union 102 and lower swivel sleeve 132 through hammer union 166. Manifold assembly 14 includes an upper cementing line 234 which is engaged by hammer union 102 in a manner known in the art. Similarly, manifold assembly 14 also includes a lower cementing line 236 engaged by hammer union 166.

Manifold assembly 14 further includes an upper valve 238 connected on one side to upper cementing line 234 and on the other side to upper tee 240. Similarly, a lower valve 242 is connected to lower cementing line 236 on one side and to lower tee 244 on the other side. Upper tee 240 and lower tee 244 are interconnected by a vertical conduit 246. Lower tee 244 includes an inlet 248 through which cement and other fluids may be provided to manifold assembly 14 and thus to the entire cementing apparatus 10.

Cementing manifold 14 is substantially identical to that of the prior art except that conduit 246 is longer than the corresponding prior art conduit. The prior art manifold assembly would have been connected to hammer unions 34 and 38 on conduit body 16.

Upper and lower valves 238 and 242 are used to control the flow of cement and other fluids so that they can be selectively diverted to the lower end of container body 16 prior to the release of dart 184, and then to the upper end of container body 16 after release of the dart.

Operation Of The Invention

Cementing head apparatus 10 has been particularly designed for use in offshore operations where very heavy loads must be suspended from the cementing head apparatus and wherein it is desirable to rotate the drill pipe and/or casing suspended below lower adapter 168 during cementing. As previously mentioned, cementing head apparatus 10 may be supported with elevator bales received about reduced diameter external surface 216 and shoulder 218 of lifting sub 260. Alternatively, as previously mentioned, a top drive unit of the drilling rig may be engaged at threaded connection 233 with upper adapter 231. Drill pipe is connected to lower adapter 168 at threaded surface 178, and the weight of the drill pipe and/or liner located therebelow is carried in tension by cementing head apparatus 10.

Cement is pumped into cementing head apparatus 10 through lower cementing line 236 and through lower swivel sleeve 132 and lower swivel mandrel 104. Releasing ball 186 is released by retracting plunger 204 of lower releasing mechanism 182 so that the ball flows downwardly near the lower end of the cement slug.

As will be understood by those skilled in the art, releasing ball 186 will seat in a bottom cementing plug (not shown) typically hung off in the casing adjacent to the ocean floor. Once it seats, the bottom cementing plug will release and flow downwardly to define the lower face of the cementing slug flowing down into the casing.

When sufficient cement has been pumped into the well to perform the cementing job, releasing dart 184 will be released by retracting plunger 188 on upper releasing mechanism 130. Fluid will then be diverted by valves 238 and 242 through upper cementing line 234 and thus through upper swivel sleeve 68 and upper swivel mandrel 40 so that dart 184 flows downwardly. Dart 184 will subsequently seat in the top cementing plug, causing it to release and flow downwardly with the cement slug adjacent to the upper extremity of the cement slug.

During this entire cementing operation, body assembly 12 which includes upper adapter 231, upper swivel mandrel 40, container body 16, lower swivel mandrel 104 and lower adapter 168 may be simultaneously reciprocated and rotated to help insure a smooth flow of cement down through the drill pipe and casing. Manifold assembly 14 does not have to be disconnected from its supply line or from body assembly 12 during this reciprocation and rotation because of the upper and lower swivel connections. That is, as body assembly 12 is rotated, upper swivel mandrel 40 rotates within upper swivel sleeve 68, and lower swivel mandrel 104 rotates within lower swivel sleeve 132. The annular channels defined between undercuts 64 and 90 in the upper swivel assembly and between undercuts 128 and 154 in the lower swivel assembly insure that there is a constant flow path from manifold assembly 14 into the central opening through body assembly 12.

It will be seen, therefore, that the swivel cementing head apparatus with manifold assembly of the present invention is well adapted to carry out the ends and advantages mentioned as well as those inherent therein. While a presently preferred embodiment of the apparatus has been described for the purposes of this disclosure, numerous changes in the arrangement and construction of parts may be made by those skilled in the art. All such changes are encompassed within the scope and spirit of the appended claims.

What is claimed is:

1. A cementing head apparatus comprising:

a body connectable to a tool string;

a cementing manifold connectable to a cement source;

releasing means for releasing a plug positionable so that the plug may be pumped down said tool string; and mounting means for rotatably mounting said manifold on said body and providing continuous fluid communication between said manifold and body, said mounting means comprising a swivel connection on opposite sides of said releasing means.

2. The apparatus of claim 1 wherein said swivel connection comprises:

a mandrel extending from said body and defining a mandrel central opening therethrough and a transverse mandrel hole in communication with said mandrel central opening; and a sleeve connected to said manifold, rotatably disposed around said mandrel and defining a transverse sleeve hole therethrough in fluid communication with said mandrel hole.

3. The apparatus of claim 2 further comprising bearing means for rotatably mounting said sleeve on said mandrel.

4. The apparatus of claim 3 wherein said bearing means is characterized by a tapered rollar thrust bearing.

5. The apparatus of claim 3 further comprising sealing means for sealing on opposite sides of said bearing means.

6. The apparatus of claim 2 further comprising sealing means for sealing between said mandrel and sleeve.

7. The apparatus of claim 2 wherein:

said mandrel has a mandrel groove in an outwardly facing surface thereof adjacent to said mandrel hole; and said sleeve has a sleeve groove in an inwardly facing surface thereof adjacent to said sleeve hole;

wherein, said sleeve and mandrel grooves are substantially aligned and define a generally annnular channel therebetween.

8. The apparatus of claim 1 further comprising indicating means for indicating when the plug has passed thereby.

9. A cementing head comprising:

a body connectable to a tool string;

an upper swivel pivotally engaged with said body and in fluid communication therewith;

lower swivel pivotally engaged with said body and in fluid communication therewith; and a cementing manifold connected to said upper and lower swivels and in fluid communication therewith such that said body is rotatable with respect to said manifold while maintaining fluid communication therebetween.

10. The cementing head of claim 9 wherein:

said upper swivel and said body define an annular upper fluid channel therebetween; and said lower swivel and said body define an annular lower fluid channel therebetween.

11. The cementing head of claim 10 further comprising sealing means for sealing between said body and said upper and lower swivels on opposite sides of said upper and lower fluid channels.

12. The cementing head of claim 9 wherein each of said upper and lower swivels comprises:

a swivel mandrel forming a portion of said body and defining:

a mandrel central opening therethrough;

a transverse mandrel hole in communication with said mandrel central opening; and an annular mandrel groove in an outer surface thereof in communication with said mandrel hole; and a swivel sleeve rotatably disposed around said mandrel and defining:

a transverse sleeve hole therethrough; and an annular sleeve groove in an inner surface thereof in communcation with said sleeve hole and said mandrel groove.

13. The cementing head of claim 12 wherein:

said mandrel comprises a flange portion extending;

said sleeve comprises a shoulder thereon facing said flange portion; and further comprising a bearing disposed between said flange portion and shoulder.

14. The cementing head of claim 13 wherein said sleeve comprises a second shoulder thereon; and further comprising:

a second bearing adjacent to said second shoulder; and a nut threadingly engaged with said mandrel and adjacent to said second bearing, whereby said bearings may be clamped in an operating position.

15. The cementing head of claim 14 wherein said bearings are characterized by tapered roller thrust bearings.

16. The cementing head of claim 14 further comprising sealing means for sealing on opposite sides of said bearings.

17. The cementing head of claim 16 wherein said sealing means comprises:

a seal disposed between said sleeve and flange portion; and another seal disposed between said sleeve and nut.

* * * * *